US009936794B2

(12) United States Patent
Rennie

(10) Patent No.: US 9,936,794 B2
(45) Date of Patent: Apr. 10, 2018

(54) PORTABLE WRENCH HOLDER

(71) Applicant: William Rennie, Surrey (CA)

(72) Inventor: William Rennie, Surrey (CA)

( * ) Notice: Subject to any disclaimer, the term of this patent is extended or adjusted under 35 U.S.C. 154(b) by 21 days.

(21) Appl. No.: 15/348,821

(22) Filed: Nov. 10, 2016

(65) Prior Publication Data

US 2017/0258212 A1 Sep. 14, 2017

Related U.S. Application Data

(60) Provisional application No. 62/307,009, filed on Mar. 11, 2016.

(51) Int. Cl.

| | |
|---|---|
| ***A45F 5/02*** | (2006.01) |
| ***B25H 3/00*** | (2006.01) |
| ***B25B 13/08*** | (2006.01) |
| ***B25H 3/04*** | (2006.01) |
| *A45F 5/00* | (2006.01) |

(52) U.S. Cl.

CPC ..... *A45F 5/021* (2013.01); *B25H 3/04* (2013.01); *A45F 2005/008* (2013.01); *A45F 2200/0575* (2013.01); *B25B 13/08* (2013.01); *B25H 3/006* (2013.01)

(58) Field of Classification Search

CPC ..... B25H 3/04; B25H 3/006; B25B 13/56; B25B 13/06; B25B 13/02; A45F 2005/008; A45F 5/00; A45F 2200/0575; Y10S 224/904

See application file for complete search history.

(56) References Cited

U.S. PATENT DOCUMENTS

| | | | | |
|---|---|---|---|---|
| 1,293,002 | A * | 2/1919 | Benton | B43L 25/10 2/250 |
| 1,809,450 | A | 6/1931 | Platt | |
| 1,889,203 | A | 11/1932 | Kress | |
| 2,030,148 | A | 2/1936 | Coyle | |
| 2,068,308 | A | 1/1937 | Zerver | |
| 2,083,130 | A | 6/1937 | Sundberg | |
| 2,119,217 | A | 5/1938 | Rocchi | |
| 2,465,290 | A | 3/1949 | Sorenson | |
| 2,530,307 | A | 11/1950 | Leach | |
| D176,313 | S * | 12/1955 | Dietz | D19/90 |
| 3,135,393 | A * | 6/1964 | Avsharian | B43K 23/001 131/257 |
| 3,370,696 | A | 2/1968 | Groe | |

(Continued)

FOREIGN PATENT DOCUMENTS

EP 0647506 A1 4/1995

OTHER PUBLICATIONS

ESPACENET, English Abstract of EP0647506, retrieved Dec. 15, 2016, 1 page.

*Primary Examiner* — Justin Larson
(74) *Attorney, Agent, or Firm* — Cameron IP

(57) ABSTRACT

A wrench holder for holding and carrying a set of wrenches, each wrench having an elongated handle and an open jaw extending from the handle, comprises a frame having a first side and a second side opposite the first side. There is a spring coiled about the first side of the frame. The spring has coils which receive the handles of the wrenches. The second side of the frame engages the open jaws of the wrenches when the handles of the wrenches are received between the coils of the spring to restrict outward rotation of the wrenches relative to the wrench holder.

14 Claims, 8 Drawing Sheets

(56) References Cited

U.S. PATENT DOCUMENTS 3,702,136 A 11/1972 Albertson
D226,039 S * 1/1973 Krone ..... D19/90
4,223,791 A * 9/1980 Taggart ..... A01K 97/10 211/120
4,545,489 A * 10/1985 Welch ..... B43M 99/008 211/11
4,884,701 A * 12/1989 Nymark ..... B25H 3/04 211/69.8
4,911,297 A 3/1990 Suburu
5,005,710 A * 4/1991 Hofer ..... B25H 3/04 206/373
5,020,666 A 6/1991 Barlean
5,082,156 A * 1/1992 Braun ..... A45F 5/00 224/220
5,137,151 A * 8/1992 Choate ..... A61B 50/22 206/370
5,173,999 A 12/1992 Welk et al.
5,346,063 A 9/1994 Chow
D366,905 S * 2/1996 Heller ..... D19/81
5,515,969 A * 5/1996 Schonenbach ..... B25H 3/02 206/373
5,730,303 A 3/1998 Chow
5,842,583 A * 12/1998 Kasa-Djukic ..... B25H 3/04 211/65
5,931,299 A 8/1999 Hsieh
5,941,386 A 8/1999 Hu et al.
6,202,864 B1 3/2001 Ernst et al.
6,305,542 B1 10/2001 Barbrow
6,315,121 B1 11/2001 Hansen
6,360,892 B1 3/2002 Chen
6,401,923 B1 6/2002 Huang
6,536,611 B2 3/2003 Chen
6,637,606 B1 10/2003 Chen
6,679,391 B1 1/2004 Huang
6,758,350 B2 7/2004 Lin
6,832,684 B2 12/2004 Huang
6,896,136 B2 5/2005 Hu
6,976,582 B2 12/2005 Chen
7,055,689 B2 6/2006 Chen
7,584,845 B2 9/2009 Cheng
7,815,058 B2 10/2010 Cheng
7,871,581 B1 * 1/2011 Coleman ..... A61L 2/26 206/210
7,987,975 B1 8/2011 Lee
7,987,981 B1 8/2011 Lee
8,016,130 B2 9/2011 Cheng
8,038,020 B2 10/2011 Vecchio et al.
8,069,997 B2 12/2011 Cheng
8,261,911 B2 9/2012 Lee
8,403,155 B1 3/2013 Kao
8,408,388 B1 4/2013 Chen
D734,612 S 7/2015 Liu
2004/0262360 A1 * 12/2004 Kaplan ..... A45C 1/04 224/674
2011/0303715 A1 * 12/2011 Mosley ..... A45F 5/02 224/682
2012/0267403 A1 * 10/2012 Ward, Jr. ..... A45F 5/00 224/219
2017/0258212 A1 * 9/2017 Rennie ..... A45F 5/021

* cited by examiner

PORTABLE WRENCH HOLDER

TECHNICAL FIELD

The present invention relates to a wrench holder and, in particular, to a portable wrench holder.

BACKGROUND

U.S. Pat. No. 1,809,450, which issued to Platt on Jun. 9, 1931, discloses a wrench kit holder for carrying a number of end wrenches or similar tools of different sizes. The wrench kit holder comprises a base member and a coiled spring carried by the base member. The coiled spring is adapted to hold shanks of wrenches between its respective coils. There is a holder hinged to the base member and adapted to swing over tops of the wrenches to retain them in the spring. A catch on the base member is arranged to cooperate with a free side of the holder to retain it in position. There is an abutment for one end of the spring on the base member. The other end of the spring is arranged to press the catch to a holding position.

U.S. Pat. No. 4,911,297, which issued to Suburu on Mar. 27, 1990, discloses a wrench holder employing a restraining bar and an upstanding slotted holding member which in combination restrain open-end heads of a wrench set. The restraining bar is mounted in angular spaced relation to the holding member whereby a wrench held in the wrench holder must be rotated through a substantial portion of a 90 degree arc before its handle is no longer engaged in a slot in the holding member and its shank and jaws are no longer constrained between the upstanding member and the restraining bar.

SUMMARY

There is provided a wrench holder for holding and carrying a set of wrenches, each of the wrenches having an elongated handle and an open jaw extending from the handle. The wrench holder comprises a frame having a first side and a second side opposite the first side. There is a spring coiled about the first side of the frame. The spring has coils which receive the handles of the wrenches. The second side of the frame engages the open jaws of the wrenches when the handles of the wrenches are received between the coils of the spring to restrict outward rotation of the wrenches relative to the wrench holder.

The frame may have spaced-apart first and second end portions, and the spring may extend between the first end portion of the frame and the second end portion of the frame. The spring may have a first end which engages with the first end portion of the frame and a second end which moves axially along the second end portion of the frame as the handles of the wrenches are received between the coils of the spring. The frame may have a hollow cross-section and the first end of the spring may be received within the first end portion of the frame to restrict movement of the first end of the spring relative to the first end portion of the frame.

The spring may have first and second ends. The first end of the spring may be secured to one end of the first side of the frame. The second end of the spring may be movable axially along the first side of the frame towards the opposite end of the frame as the handles of the wrenches are received between the coils of the spring. The frame and the spring may be unitary.

The frame may be a quadrilateral. The first side of the frame and the second side of the frame may be angled relative to each other. The frame may further include third and fourth sides extending between the first side and the second side thereof. At least one of the first side of the frame and the second side of the frame may slope between the third side of the frame and the fourth side of the frame. The frame may include a strap to releasably attach the wrench holder to a user.

There is also provided a wrench holder for holding and carrying a set of wrenches. The wrench holder comprises a frame having spaced-apart first and second end portions. There is a spring extending between the first end portion of the frame and the second end portion of the frame. The spring has a first end which engages with the first end portion of the frame and a second end which fits over the second end portion of the frame. The first end of the spring remains substantially stationary relative to the first end portion of the frame and the second end of the spring moves axially along the second end portion of the frame when the wrenches are received between coils of the spring. Open jaws of the wrenches may engage the frame when the wrenches are received between the coils of the spring to restrict outward rotation of the wrenches relative to the wrench holder. The frame may have a tapered configuration.

There is further provided a wrench holder in combination with a set of wrenches. The wrenches each have an elongated handle and an open jaw extending from the handle. The wrench holder has a frame with spaced-apart first and second end portions, and a spring extending between the first end portion of the frame and the second end portion of the frame. The spring has a first end which engages with the first end portion of the frame and a second end which fits over the second end portion of the frame. The first end of the spring remains substantially stationary relative to the first end portion of the frame and the second end of the spring moves axially along the second end portion of the frame when the handles of the wrenches are received between coils of the spring. The open jaws of the wrenches engage the frame when the handles of the wrenches are received between the coils of the spring to restrict outward rotation of the wrenches relative to the wrench holder.

DESCRIPTION OF EMBODIMENTS

Figure 1:
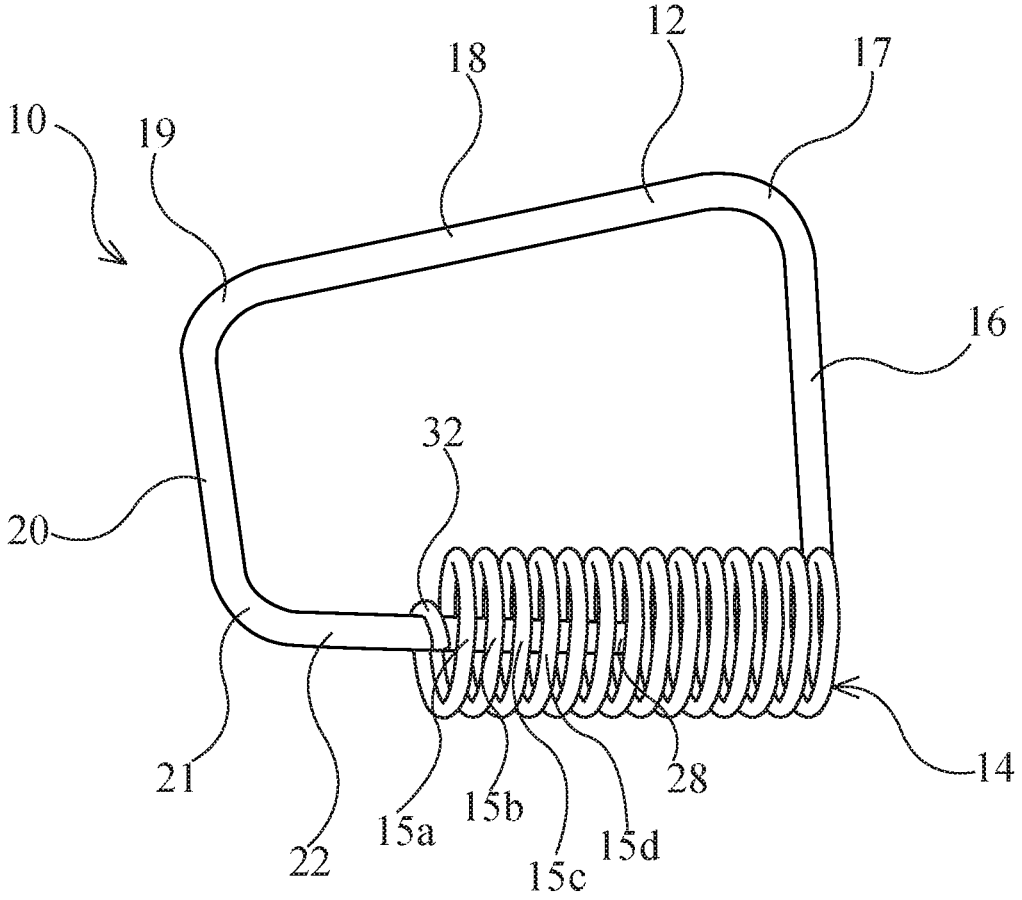
FIG. 1 is a top plan view of a first wrench holder for holding and carrying a set of wrenches.
Figure 2:
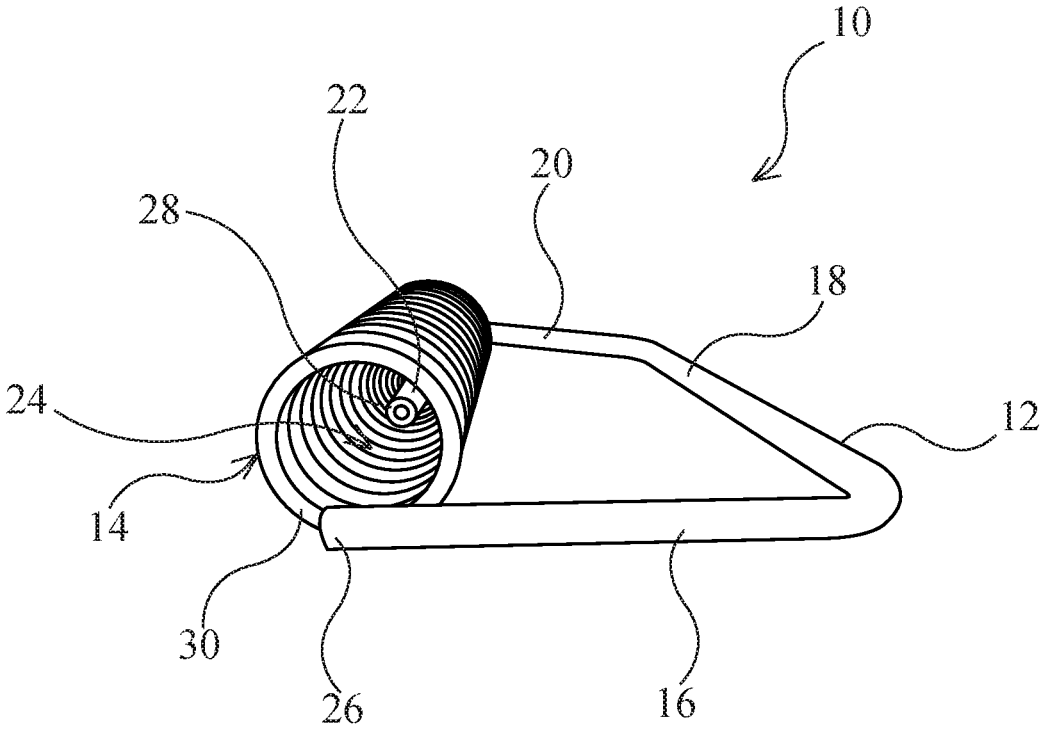
FIG. 2 is a side perspective view of the wrench holder of FIG. 1.

Referring to the drawings and first to FIGS. 1 and 2, there is shown a first wrench holder 10 for holding and carrying a set of wrenches. The wrench holder 10 includes a frame 12 and a coil spring 14. The frame 12 is a generally loop-shaped quadrilateral in this example and includes four sides 16, 18, 20 and 22. The spring 14 is coiled about one of the sides of the frame 12 which in this example is the side 22. The spring 14 in this example is generally cylindrical with a plurality of spaced-apart coils, for example, adjacent coils 15*a*, 15*b*, 15*c* and 15*d*. The coils 15*a*, 15*b*, 15*c* and 15*d* in this example are similar in size to each other and are evenly spaced-apart from one another. However, the coils 15*a*, 15*b*, 15*c* and 15*d* of the spring 14 may abut each other in other examples. The sides 16, 18, 20 and 22 of the frame 12 are substantially straight in this example and are joined by rounded corner portions 17, 19 and 21. The frame 12 may be formed from a single piece of suitable material such as metal or plastic. The frame 12 is tapered in this example such that the sides 18 and 22 slope between the sides 16 and 20. The sides 18 and 22 accordingly extend between the sides 16 and 20 in non-parallel relation to each other and converge towards the side 20. The side 16 has a length which is greater than that of the side 20 in this example.

As best shown in FIG. 2, there may be a space 24 in the side 22 of the frame 12 which results in the frame having spaced-apart end portions 26 and 28 of the sides 16 and 22, respectively. The frame 12 is tubular in this example and has a hollow cross-section which allows the end portion 26 to receive a first end 30 of the spring 14. The first end 30 of the spring 14 is press fitted into the side 16 of the frame 12 to restrict movement of the first end 30 of the spring 14 relative to the end portion 26 of the frame 12. A second end 32 of the spring 14, which is best shown in FIG. 1, is hook-like and engages the end portion 28 of the frame 12. The second end 32 of the spring 14 translates or moves axially along the side 22 of the frame 12 as the spring 14 stretches and compresses. The first end 30 of the spring 14 remains substantially stationary relative to the frame 12 and, in particular, to the side 16 of the frame 12, as the second end 32 of the spring 14 moves axially along the side 22 of the frame 12.

Figure 3:
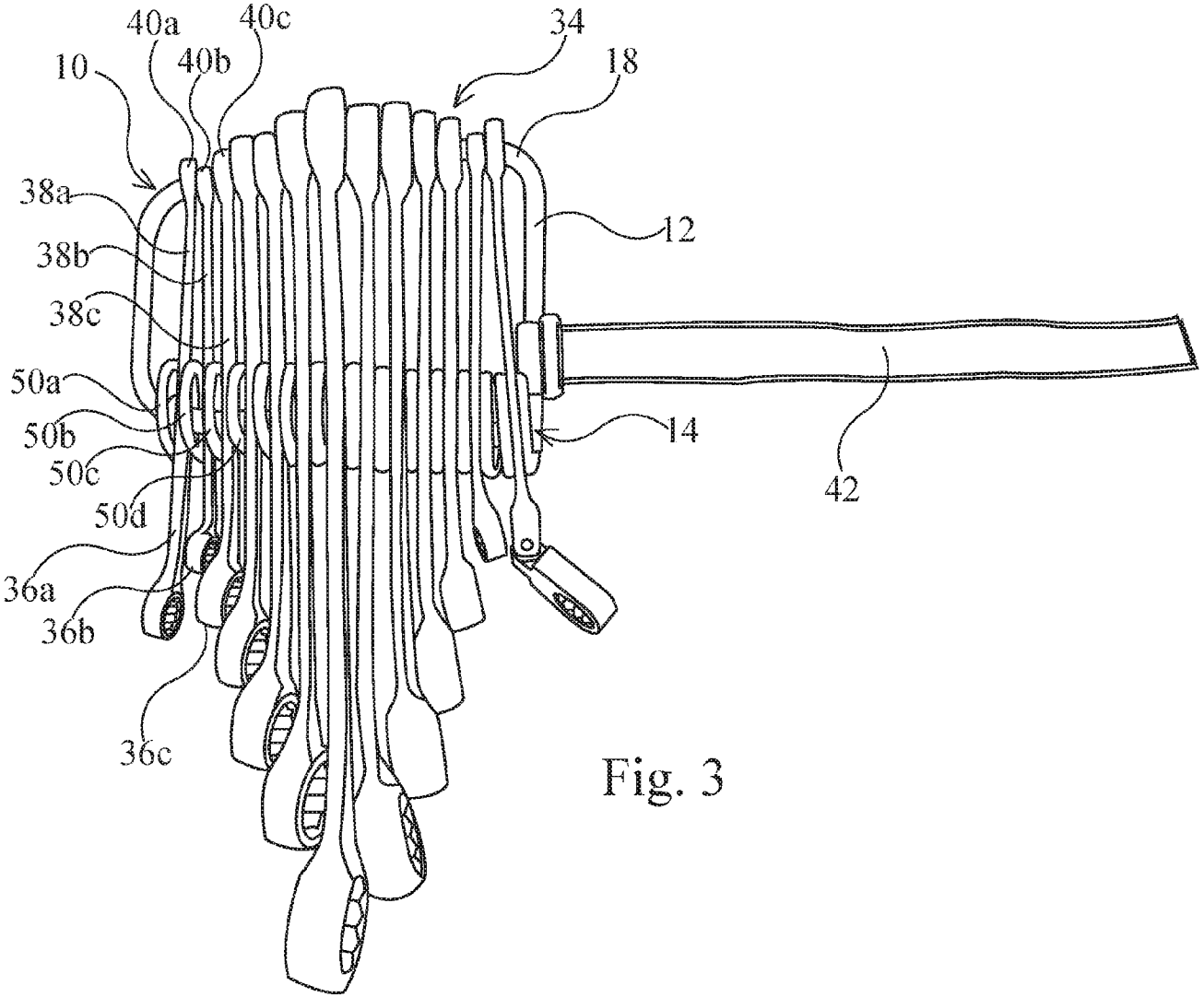
FIG. 3 is a top plan view of the wrench holder of FIG. 1 showing the wrench holder holding a set of wrenches.
Figure 4:
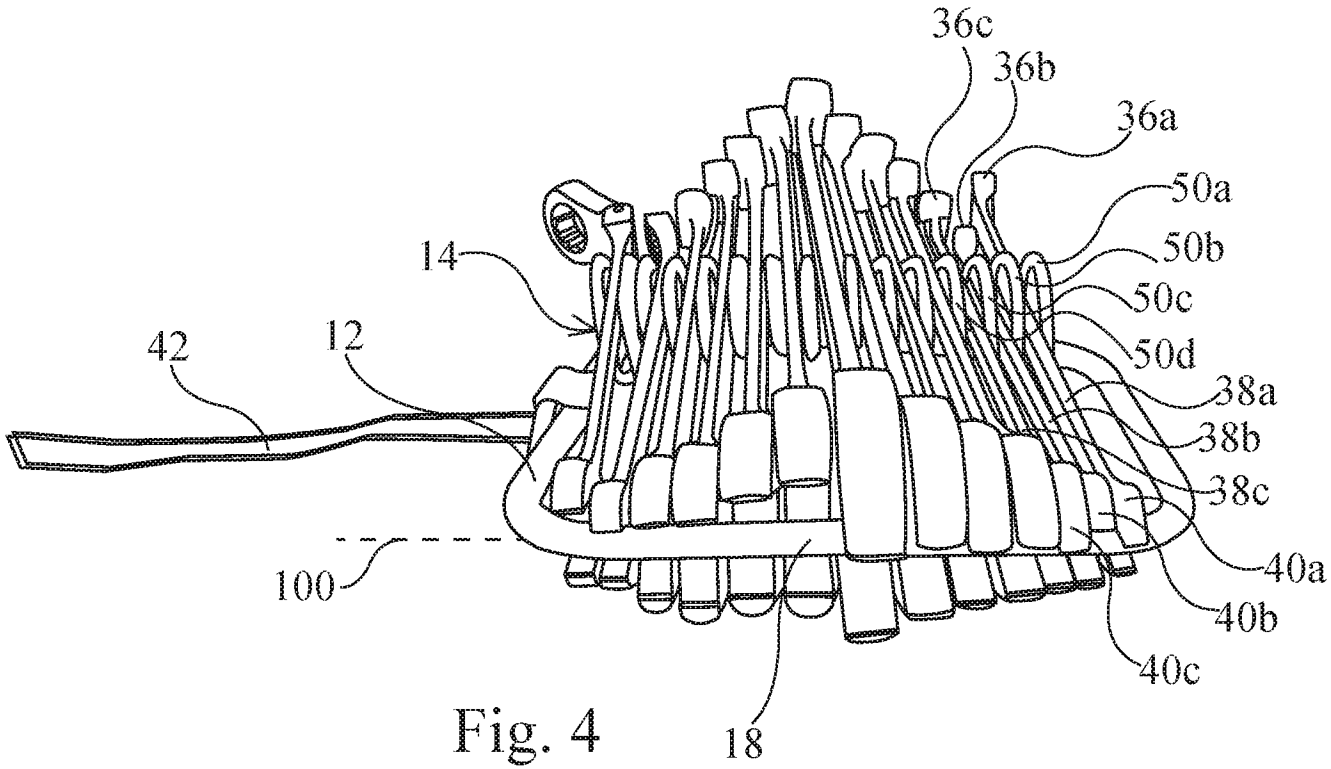
FIG. 4 is an end perspective view of the wrench holder of FIG. 1 showing the wrench holder holding the set of wrenches.

Referring now to FIG. 3, the wrench holder 10 is shown holding a set of wrenches 34 which includes wrenches 36*a*, 36*b* and 36*c*. Handles of the wrenches are inserted between the adjacent coils 15*a*, 15*b*, 15*c* and 15*d* of the spring 14 as shown for respective handles 38*a*, 38*b* and 38*c* of the wrenches 36*a*, 36*b* and 36*c*. Respective open jaws 40*a*, 40*b* and 40*c* of the wrenches 36*a*, 36*b* and 36*c* are also fitted over the side 18 of the frame 12 as best shown in FIG. 4. The restoring force of the spring 14, i.e. the force exerted when the spring is stretched and which brings the spring back towards its equilibrium length, holds the wrenches 36*a*, 36*b* and 36*c* in position when their respective handles 38*a*, 38*b* and 38*c* are inserted between the coils 15*a*, 15*b*, 15*c* and 15*d* of the spring 14. Furthermore, the side 18 of the frame 12 is received by and engages the open jaws 40*a*, 40*b* and 40*c* of the wrenches 36*a*, 36*b* and 36*c* to restrict outward rotation of the wrenches 36*a*, 36*b* and 36*c* relative to the wrench holder 10 when their respective handles 38*a*, 38*b* and 38*c* are inserted between the coils 15*a*, 15*b*, 15*c* and 15*d* of the spring 14. In particular, the side 18 limits the degree of permissible rotation of the wrenches relative to a longitudinal axis 100 of the frame 12 once the wrenches are inserted between the coils of the spring 14. The spring 14 and the side 18 of the frame 12 accordingly work in combination to securely hold the wrenches.

The resilience of the spring 14 allows the spring to stretch to accommodate wrenches of different thicknesses. The restoring force of the spring 14 means that wrenches having handles of varying thicknesses are still securely retained between its coils 15*a*, 15*b*, 15*c* and 15*d*. However, even when the spring 14 is at its equilibrium length, the coils 15*a*, 15*b*, 15*c* and 15*d* of the spring 14 are spaced-apart at a distance that allows wrenches having thinner handles to still be sufficiently retained between the coils 15*a*, 15*b*, 15*c* and 15*d*.

The restoring force of the spring 14 also means that wrenches are securely retained between its coils 15*a*, 15*b*, 15*c* and 15*d* when any number of wrenches between the maximum and the minimum number of wrenches capable of being retained by the spring 14 is inserted between the coils 15*a*, 15*b*, 15*c* and 15*d* of the spring 14. The wrench holder 10 can therefore hold as many or as few wrenches as needed by a user.

Since the wrenches only engage the frame 12 at their respective open jaws, the wrench holder 10 can also accommodate wrenches of different lengths. The handles of the wrenches extend outwardly beyond the spring 14. Since the side 16 of the frame 12 is longer than the opposite side 20 in this example, the distance between the sides 18 and 22 is greater near the side 16 and decreases towards the side 20. Wrenches having shorter handles can therefore be inserted between the coils 15*a*, 15*b*, 15*c* and 15*d* of the spring 14 near the side 20 of the frame 12 where the distance between the sides 18 and 22 is smaller. This allows the open jaws of shorter wrenches to engage the side 18 of the frame 12 while the handles of the wrenches are retained between the coils 15*a*, 15*b*, 15*c* and 15*d* of the spring 14. Conversely, wrenches having longer handles can be inserted between the coils 15*a*, 15*b*, 15*c* and 15*d* of the spring 14 near the side 16 of the frame 12 where the distance between the sides 18 and 22 is greater.

The wrench holder 10 may include a strap 42, best shown in FIG. 3, for releasably attaching the wrench holder to, for example, a belt of a user to allow the user to carry and easily access the wrenches retained by the wrench holder during use. The wrench holder 10 may also be used in conjunction with a tool box to organize wrenches within the tool box. The wrench holder 10 may be transported in the tool box between locations and/or stored in the tool box when not in use. The wrench holder 10 may be colour-coded to further facilitate organization and ease of use of the wrenches. For example, a first one of the wrench holders may be used to hold wrenches of metric sizes and may be coded one colour, such as blue, and a second one of the wrench holders may be used to hold wrenches of imperial sizes and may be coded another colour, such as red. This allows a user to readily identify and select the desired measurement size of wrenches.

The order of the wrenches held in the wrench holder 10 shown in FIGS. 3 and 4 is intended to be an example only. It will be understood by a person skilled in the art that the wrenches can be inserted into the wrench holder 10 in different ways to arrange the wrenches in different orders.

Figure 5:
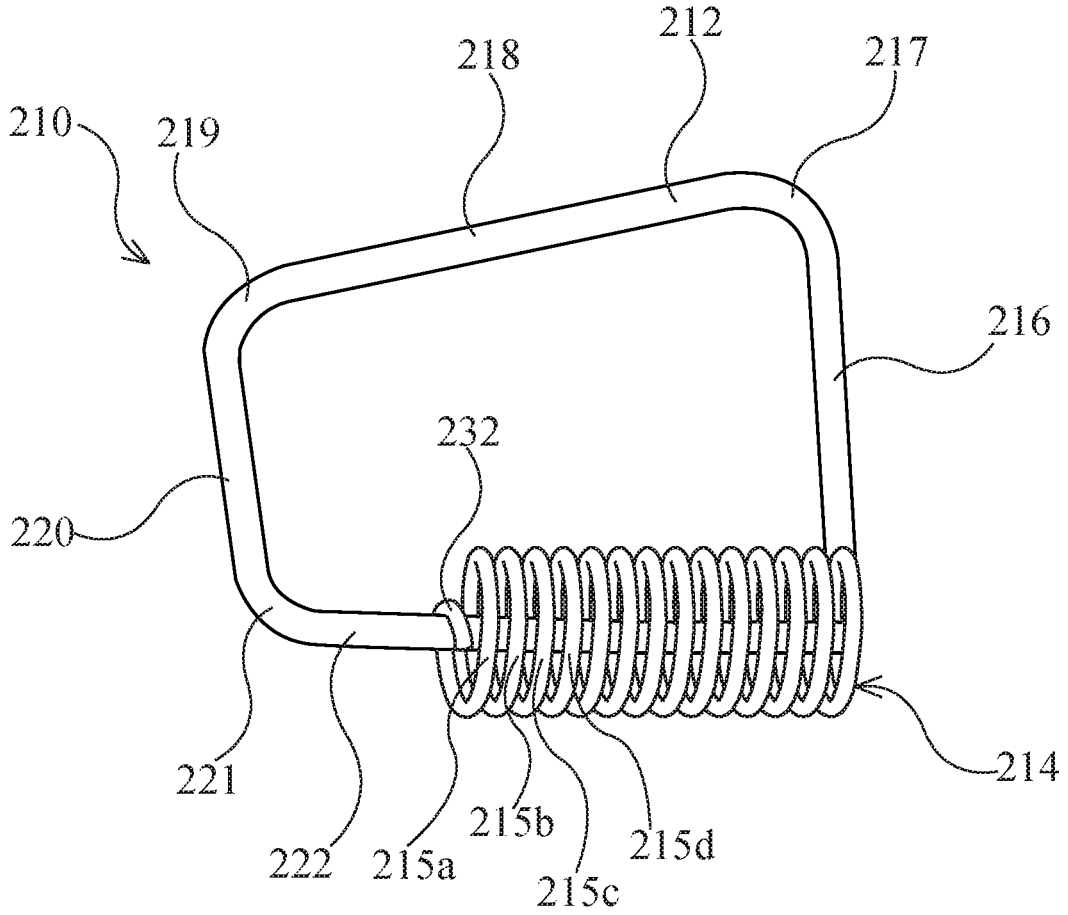
FIG. 5 is a top plan view of a second wrench holder for holding and carrying a set of wrenches.
Figure 6:
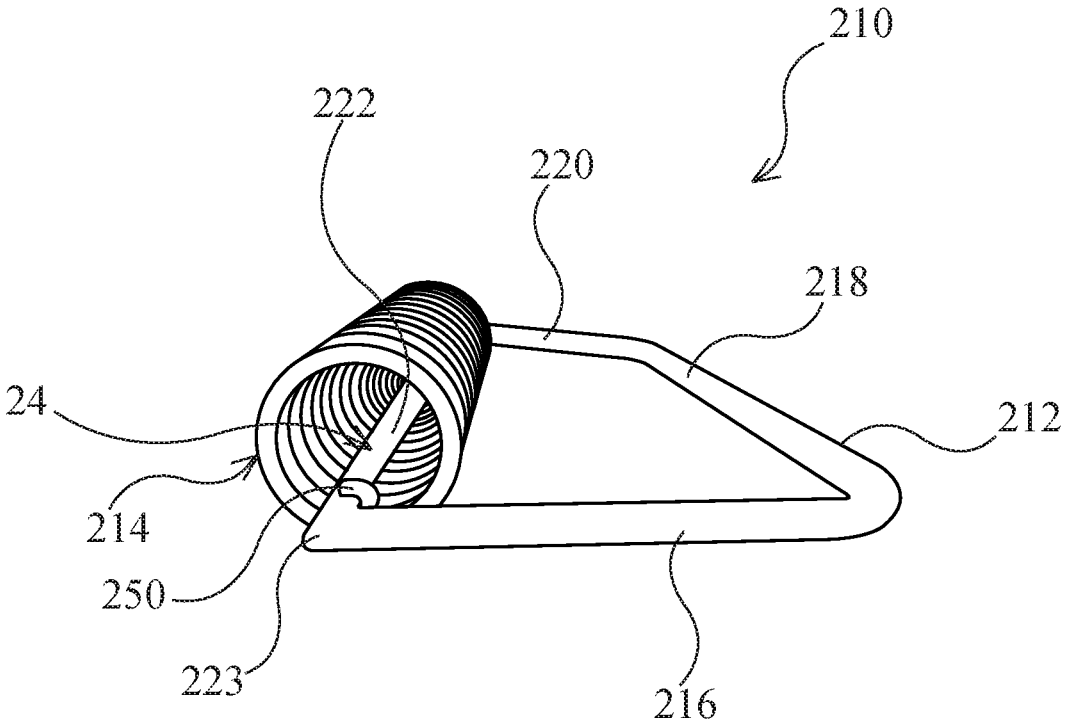
FIG. 6 is a side perspective view of the wrench holder of FIG. 5.

Referring now to FIGS. 5 and 6, there is shown a wrench holder 210 for holding and carrying a set of wrenches. Like parts have like numbers and functions as the wrench holder 10 described above and shown in FIGS. 1 to 4 except in the 200 series. The wrench holder 210 is substantially the same as the wrench holder 10 described above and shown in FIGS. 1 to 4 with the exception that there is no space in the side 222 of the frame 212. The sides 216 and 222 of the frame 212 are joined by a corner portion 223 which is sharp in this example but may be rounded in other examples. A first end 250 of the spring 214 is hook-like and engages the side 222 of the frame 212 proximal to the side 216. The first end 250 of the spring 214 is secured to the side 222 of the frame 212 adjacent to the corner portion 223, for example, by being crimped onto the side 222. The second end 232 of the spring 214 is also hook-like and engages the side 222 of the frame 212 proximal to the corner portion 221. However, the second end 232 of the spring 214 translates or moves axially along the side 222 of the frame 212 as the spring 214 stretches and compresses to accommodate wrenches inserted between its coils. In contrast, the first end 250 of the spring 214 remains substantially stationary relative to the frame 212 and, in particular, to the side 216 of the frame 212, as the second end 232 of the spring 214 moves axially along the side 222 of the frame 212.

Figure 7:
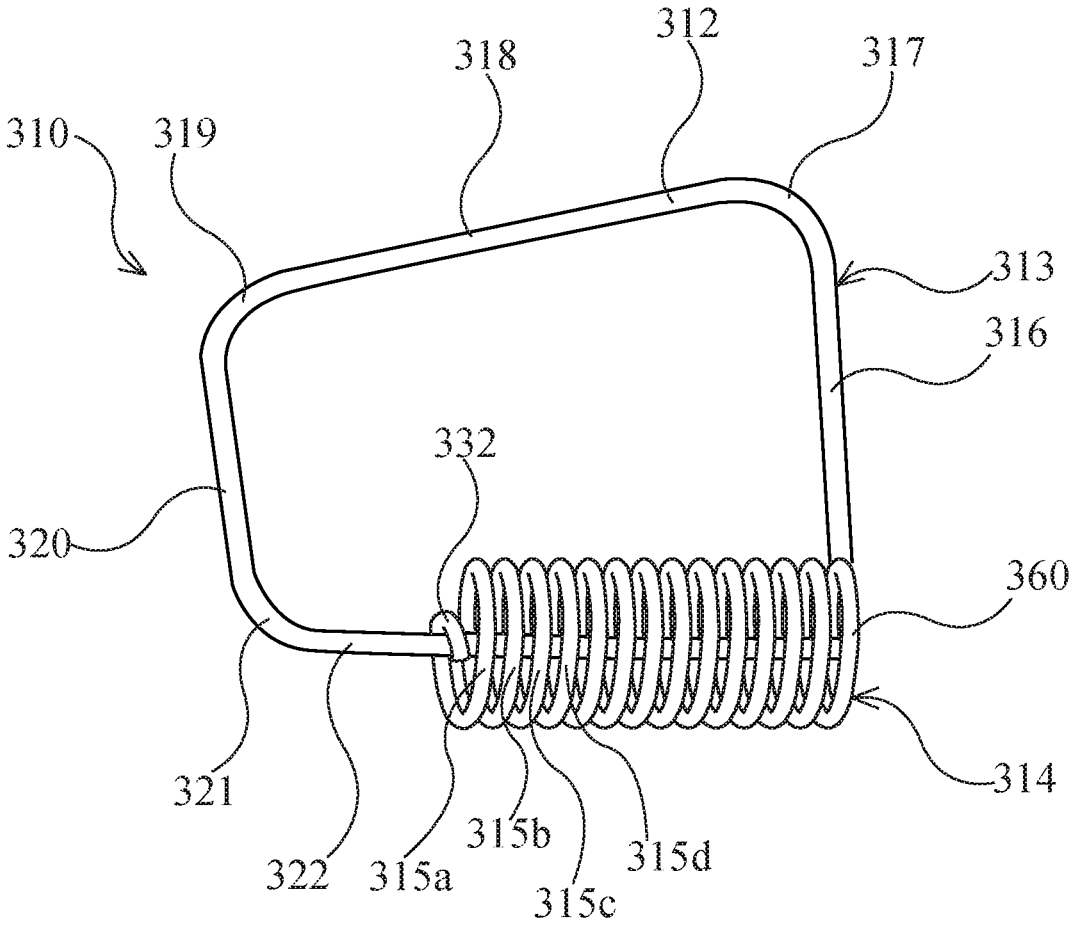
FIG. 7 is a top plan view of a third wrench holder for holding and carrying a set of wrenches.
Figure 8:
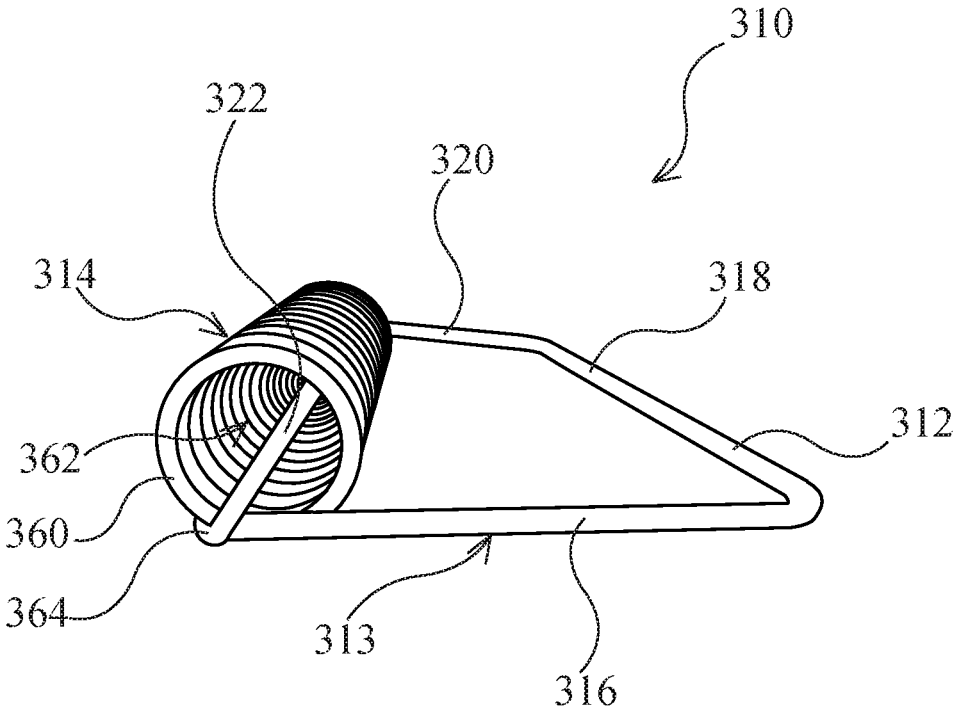
FIG. 8 is a side perspective view of the wrench holder of FIG. 7.

Referring now to FIGS. 7 and 8, there is shown a third wrench holder 310 for holding and carrying a set of wrenches. Like parts have like numbers and functions as the wrench holder 10 described above and shown in FIGS. 1 to 4 except in the 300 series. In this example, the wrench holder 310 comprises a frame 312 and a coil spring 314 which are unitary and are formed from a single member 313. The member 313 is a single length of metal wire in this example. An end coil 360 of the member 313 straightens and extends outwardly to form a first side 316 of the frame 312. The frame 312 is bent at corner portions 317, 319 and 321 to form the remaining sides 318, 320 and 322. The corner portions 317, 319 and 321 are rounded in this example while the sides 316, 318, 320 and 322 are substantially straight in this example. Accordingly, in this example, the frame 312 is a generally loop-shaped quadrilateral. The side 322 of the frame 312 extends through an interior space 362 of the spring 314 and an end portion 364 of the frame 312 is secured to the spring 314 adjacent to the end coil 360. The end portion 364 of the frame 312 may be crimped onto the end coil 360 to secure the end portion 364 to the spring 314.

A free end 332 of the spring 314 is hook-like and engages the side 322 of the frame 312. The end 332 of the spring 314 translates or moves axially along the side 322 of the frame 312 as the spring 314 stretches and compresses to accommodate wrenches inserted between its coils. Since the end coil 360 is integral with the side 316 of the frame 212 in this example, the end coil 360 remains substantially stationary relative to the frame 212 as the end 332 of the spring 314 moves axially along the side 322 of the frame 312.

It will be further understood by a person skilled in the art that many of the details provided above are by way of example only, and are not intended to limit the scope of the invention which is to be determined with reference to the following claims.

What is claimed is:

1. A wrench holder for holding and carrying a set of wrenches, each wrench having an elongated handle and an open jaw extending from the handle, the wrench holder comprising:

a frame having a first side and a second side opposite the first side; and a spring coiled about the first side of the frame, the spring having coils which receive the handles of the wrenches;

wherein the spring has a first end and a second end, the first end of the spring engaging the frame and the second end of the spring moving axially along the first side of the frame as the handles of the wrenches are received between the coils of the spring, and wherein the second side of the frame engages the open jaws of the wrenches when the handles of the wrenches are received between the coils of the spring to restrict outward rotation of the wrenches relative to the wrench holder.

2. The wrench holder as claimed in claim 1, wherein the frame has spaced-apart first and second end portions, and wherein the spring extends between the first end portion of the frame and the second end portion of the frame.

3. The wrench holder as claimed in claim 2, wherein the frame has a hollow cross-section and the first end of the spring is received within the first end portion of the frame to restrict movement of the first end of the spring relative to the first end portion of the frame.

4. The wrench holder as claimed in claim 1, wherein the spring has first and second ends, the first end of the spring being secured to one end of the first side of the frame and the second end of the spring being movable axially along the first side of the frame towards the opposite end of the frame as the handles of the wrenches are received between the coils of the spring.

5. The wrench holder as claimed in claim 1, wherein the frame and the spring are unitary.

6. The wrench holder as claimed in claim 1, wherein the frame is a quadrilateral.

7. The wrench holder as claimed in claim 1, wherein the first side of the frame and the second side of the frame are angled relative to each other.

8. The wrench holder as claimed in claim 1, wherein the frame further includes third and fourth sides extending between the first side and the second side thereof, and wherein at least one of the first side of the frame and the second side of the frame slopes between the third side of the frame and the fourth side of the frame.

9. The wrench holder as claimed in claim 1, wherein the frame includes a strap to releasably attach the wrench holder to a user.

10. A wrench holder for holding and carrying a set of wrenches, the wrench holder comprising:

a frame having spaced-apart first and second end portions; and a spring extending between the first end portion of the frame and the second end portion of the frame, the spring having a first end which engages with the first end portion of the frame and a second end which fits over the second end portion of the frame;

wherein the first end of the spring remains substantially stationary relative to the first end portion of the frame and the second end of the spring moves axially along the second end portion of the frame when the wrenches are received between coils of the spring.

11. The wrench holder as claimed in claim 10, wherein open jaws of the wrenches engage the frame when the wrenches are received between the coils of the spring to restrict outward rotation of the wrenches relative to the wrench holder.

12. The wrench holder as claimed in claim 10, wherein the frame has a tapered configuration.

13. The wrench holder as claimed in claim 10, wherein the frame includes a strap to releasably attach the wrench holder to a user.

14. In combination, a wrench holder and a set of wrenches:

the wrenches each having an elongated handle and an open jaw extending from the handle; and the wrench holder having a frame with spaced-apart first and second end portions, and a spring extending between the first end portion of the frame and the second end portion of the frame, the spring having a first end which engages with the first end portion of the frame and a second end which fits over the second end portion of the frame;

wherein the first end of the spring remains substantially stationary relative to the first end portion of the frame and the second end of the spring moves axially along the second end portion of the frame when the handles of the wrenches are received between coils of the spring; and wherein the open jaws of the wrenches engage the frame when the handles of the wrenches are received between the coils of the spring to restrict outward rotation of the wrenches relative to the wrench holder.

* * * * *